US010006284B2

(12) United States Patent
Naveena-Chandran et al.

(10) Patent No.: US 10,006,284 B2
(45) Date of Patent: Jun. 26, 2018

(54) USING SCREENED PADS TO FILTER UNCONSOLIDATED FORMATION SAMPLES

(71) Applicant: HALLIBURTON ENERGY SERVICES, INC., Houston, TX (US)

(72) Inventors: Rohin Naveena-Chandran, Houston, TX (US); Carl Bismarck Ferguson, La Porte, TX (US); James Patrick McBride, Houston, TX (US); Alison F. Foo-Karna, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 120 days.

(21) Appl. No.: 14/771,772

(22) PCT Filed: Feb. 28, 2014

(86) PCT No.: PCT/US2014/019695

§ 371 (c)(1),
(2) Date: Aug. 31, 2015

(87) PCT Pub. No.: WO2014/137843

PCT Pub. Date: Sep. 12, 2014

(65) Prior Publication Data

US 2016/0010455 A1 Jan. 14, 2016

Related U.S. Application Data

(60) Provisional application No. 61/771,975, filed on Mar. 4, 2013.

(51) Int. Cl.
*E21B 49/10* (2006.01)
*E21B 49/08* (2006.01)

(52) U.S. Cl.
CPC ..... *E21B 49/10* (2013.01); *E21B 49/082* (2013.01)

(58) Field of Classification Search
CPC ..... E21B 49/10; E21B 49/082; E21B 49/008
See application file for complete search history.

(56) References Cited

U.S. PATENT DOCUMENTS 6,092,604 A * 7/2000 Rice ..... B01D 29/15 166/228
8,276,662 B2 * 10/2012 Niconoff ..... E21B 43/08 137/625.29

(Continued)

FOREIGN PATENT DOCUMENTS

WO 2014/137843 9/2014

OTHER PUBLICATIONS

CA Examination Report, dated Jun. 13, 2016, Appl No. 2,900,079, "Using Screened Pads to Filter Unconsolidated Formation Samples," Filed Feb. 28, 2014, 4 pgs.

(Continued)

*Primary Examiner* — David J Bagnell
*Assistant Examiner* — Yanick A Akaragwe
(74) *Attorney, Agent, or Firm* — Benjamin Fite; Parker Justiss, P.C.

(57) ABSTRACT

A fluid-sampling system that includes a downhole tool string with a fluid-sampling tool coupled thereto, and a fluid sampling probe coupled to the tool via a probe extension arm, the fluid sampling probe having an oval pad that contacts a borehole wall, one or more fluid inlets which receive a formation fluid, and a plurality of screens between the borehole wall and the one or more fluid inlets which filter the formation fluid. The fluid-sampling system further including one or more offset arms coupled to the tool which contact the borehole wall.

22 Claims, 5 Drawing Sheets

(56) References Cited

U.S. PATENT DOCUMENTS

| | | | | |
|---|---|---|---|---|
| 2003/0145652 | A1 | 8/2003 | Arian | |
| 2004/0154807 | A1* | 8/2004 | Howlett | E21B 17/1014 166/382 |
| 2007/0039731 | A1 | 2/2007 | Fox et al. | |
| 2009/0107684 | A1* | 4/2009 | Cooke, Jr. | E21B 23/00 166/376 |
| 2009/0211752 | A1 | 8/2009 | Goodwin et al. | |
| 2010/0218943 | A1 | 8/2010 | Nold, III et al. | |
| 2011/0162837 | A1* | 7/2011 | O'Malley et al. | B01J 20/041 166/267 |
| 2012/0034377 | A1 | 2/2012 | Hailey, Jr. | |
| 2012/0111632 | A1 | 5/2012 | Sherrill et al. | |
| 2012/0145389 | A1 | 6/2012 | Fitzpatrick, Jr. | |
| 2015/0076051 | A1* | 3/2015 | Provo | E21B 43/084 210/232 |

OTHER PUBLICATIONS

PCT International Preliminary Report on Patentability, dated Sep. 17, 2015, Appl No. PCT/US2014/019695, "Using Screened Pads to Filter Unconsolidated Formation Samples," Filed Feb. 28, 2014, 10 pgs.

PCT International Search Report and Written Opinion, dated Jun. 8, 2014, Appl No. PCT/US2014/019695, "Using Screened Pads to Filter Unconsolidated Formation Samples," Filed Feb. 28, 2014, 15 pgs.

* cited by examiner

USING SCREENED PADS TO FILTER UNCONSOLIDATED FORMATION SAMPLES

CROSS-REFERENCE TO RELATED APPLICATIONS

This application claims priority to Provisional U.S. Application 61/771,975, titled "Systems and Methods Employing Screened Oval Pads for Sampling from Unconsolidated Formations" and filed Mar. 4, 2013 by Rohin Naveena-Chandran, Carl B. Ferguson, James P. Mcbride & Alison F. Foo-Kama, which is hereby incorporated herein by reference.

BACKGROUND

In the search for hydrocarbon bearing formations, a well may be drilled and tested prior to completion and production. To determine properties and evaluate a formation after the wellbore is drilled, oilfield service companies offer a multitude of tools and techniques. For example, "wireline" tools may be suspended in the borehole by a cable. Such cables may further include support equipment for the tool, such as associated power, pump, storage, and communication equipment.

A question often sought to be resolved with such tools concerns the fluid hydrocarbon content of selected formations. Fluid sampling tools offer the opportunity to capture fluid samples directly from the formation and isolate them for analysis in-situ or when the tool returns to the surface. Halliburton offers one such tool under the name Reservoir Description Tool or RDT™. Such tools generally operate by pressing a probe against the borehole wall and, through the use of gradually-reduced pressure (i.e., suction), drawing fluid from the surrounding formation. However in some situations, the tool's suction, or even the pressure from the probe, can cause poorly consolidated formations to crumble, yielding sand or other small particulates along with the formation fluid, thus degrading analysis of the formation fluid and/or clogging of the probe or internal flow lines entirely.

Recognizing this hazard, the industry has attempted various solutions including the use of multiple probes and designing tool internals to be extremely robust to the presence of a high percentage of solids in the sample. Yet sampling failures still occur and even better tool performance is sought.

BRIEF DESCRIPTION OF THE DRAWINGS

Accordingly, there are disclosed herein systems and methods employing screened oval pads for sampling from unconsolidated formations. In the drawings.

Figure 1:
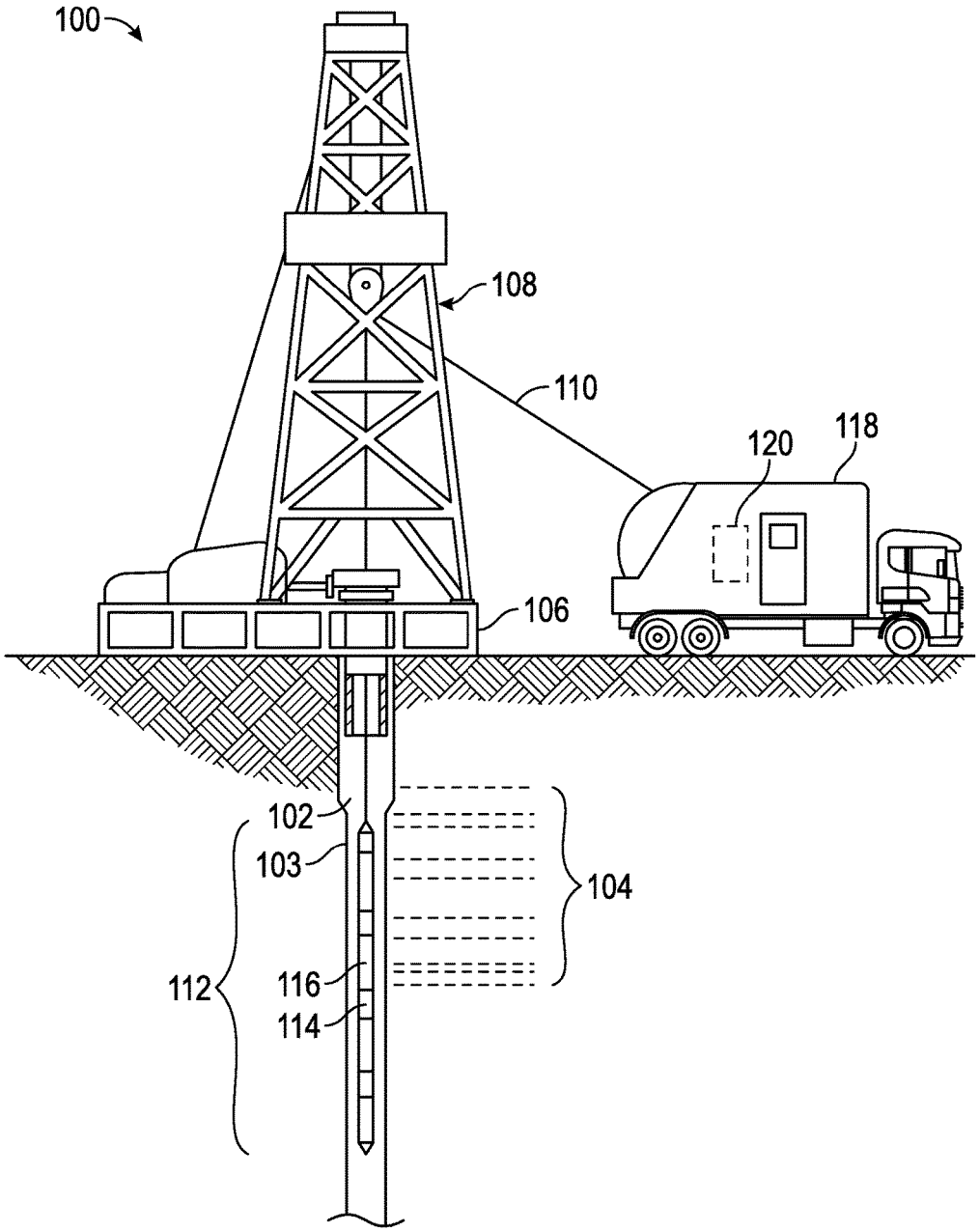
FIG. 1 shows an illustrative wireline tool environment.

It should be understood, however, that the specific embodiments given in the drawings and detailed description do not limit the disclosure. On the contrary, they provide the foundation for one of ordinary skill to discern the alternative forms, equivalents, and modifications that are encompassed in the scope of the appended claims.

DETAILED DESCRIPTION

Disclosed herein is a fluid-sampling probe including a pad that contacts a borehole wall, inlets which receive a formation fluid, and a plurality of screens between the borehole wall and the inlets which filter particulates from the formation fluid. The disclosed screening technique may be particularly suitable for use with an oval pad from Halliburton's RDT™ tool as it forms a cross-flow region that permits the formation fluid to reach the inlets from a surface area significantly larger than the inlets' cross-sectional area alone. That is, the screens mitigate entry of unconsolidated fines or particulates into the inlets during formation sampling operations, thereby also mitigating an industry recognized problem of internal flow lines becoming clogged by the particulates during formation sampling. Such techniques additionally enlarge and enhance the flow area which delivers formation fluids to the inlets.

FIG. 1 depicts an illustrative wireline environment 100. In FIG. 1, a borehole 102 with a borehole wall 103 has been drilled through various formations 104. A drilling platform 106 supports a derrick 108 capable of raising and lowering a wireline cable 110 and tool string 112 through the borehole 102. As depicted, the tool string 112 includes a fluid sampling tool 114 and a telemetry sub 116. However, additional tools may also be included on the tool string 112, such as logging tools, pumps, fluid analyzers, and storage chambers.

The fluid sampling tool 114 is capable of receiving a formation fluid 122, whereby measurements of the formation fluid 122 may be taken, for example, by either the fluid-sampling tool 114 or other tools coupled to the tool string 112. Such measurements may be stored in internal memory of the telemetry sub 116. Alternatively, the measurements may be communicated to the surface via a communications link. A computing or logging facility 118 which includes a computer system 120 may be arranged at the surface to receive such communications. The logging facility 118 may be configured to manage tool string 116 operations, acquire and store the measurements, and process the measurements for display to an operator.

While the wireline environment 100 of FIG. 1 is depicted as a land-based environment with a vertical wellbore 16, it is contemplated herein that the same principles may be applied to a sea-based environment, as well as a deviated or horizontal wellbore without departing from the scope of the disclosure.

Figure 2:
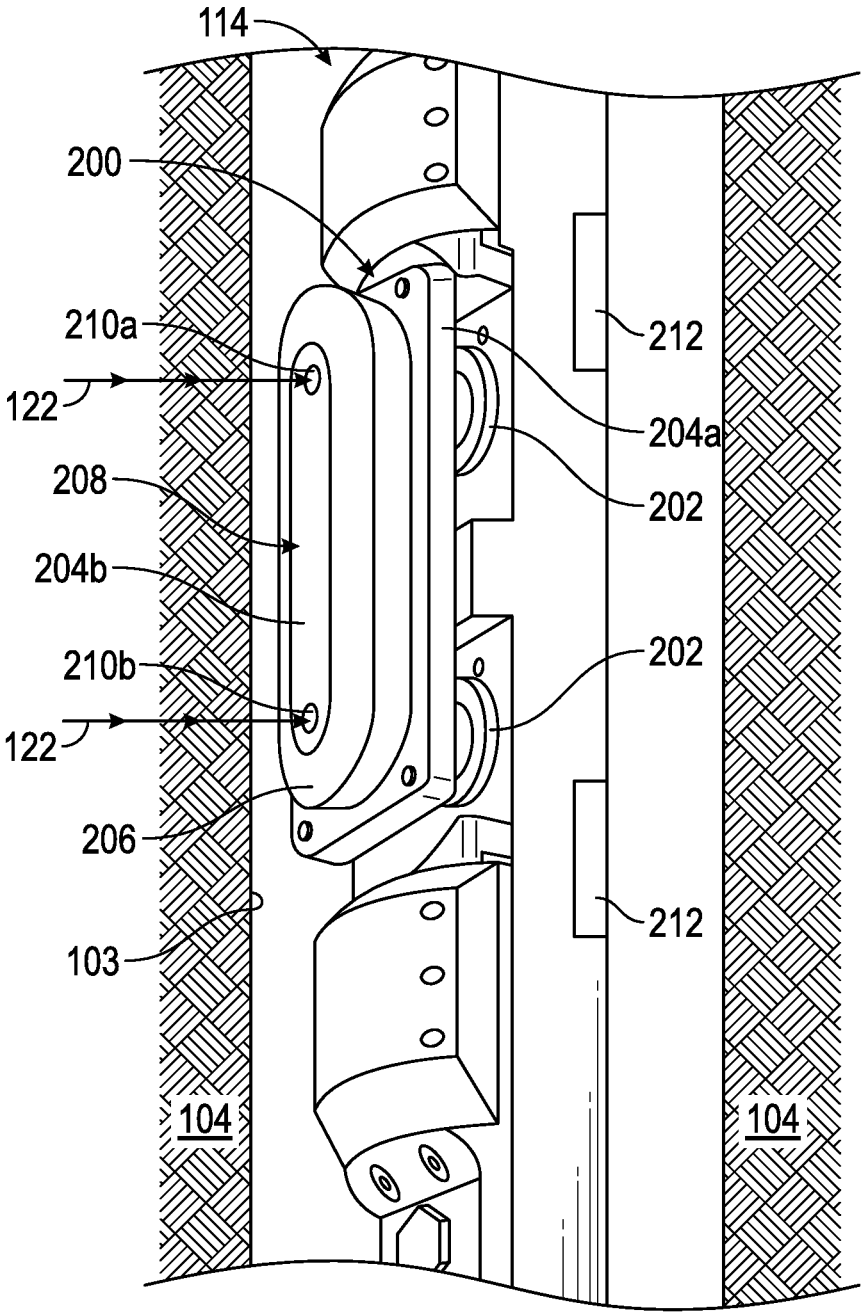
FIG. 2 shows an enlarged view of an illustrative fluid-sampling tool in a borehole.

FIG. 2 depicts an enlarged view of the fluid sampling tool 114 of FIG. 1 deployed downhole in the borehole 102. The fluid sampling tool 114 includes a fluid-sampling probe 200 (hereinafter "probe 200"). As depicted, the probe 200 is in a first or recessed state for transportation of the fluid-sampling tool 114 downhole. However, upon the fluid-sampling tool 114 being conveyed to a predetermined position in the borehole 102, the probe 200 may be configured in a second configuration, wherein the probe 200 is extended via one or more probe extension arms 202 (two shown) to contact the borehole wall 103 and enable sampling of the formation fluid 122.

As depicted, the probe 200 includes a probe body base 204*a* with a pad 206 coupled or arranged adjacent thereto. The pad 206 includes a hole or recessed area 208 enabling flow of the formation fluid 122 therethrough and into the probe 200, thus eventually into the fluid-sampling tool 114.

In one embodiment, the pad 206 may be made of a rubber capable of being compressed or flexing upon being pressed against the borehole wall 103, thus essentially forming a seal therewith to prevent borehole fluid from interfering with the sampling operation. Alternatively, the pad 206 may be made of a metal, plastic, polymer, or the like capable of being compressed or flexing upon being pressed against the borehole wall 103. As depicted, the pad 206 is oval in nature. However, it should be appreciated that the pad 206 may be otherwise shaped, such as being circular. The probe 200 may further include one or more inlets 210 (illustrated as a first inlet 210*a* and a second inlet 210*b*) which receive the formation fluid 122. The inlets 210*a-b* may be operated together or independently during formation fluid 122 sampling. An exterior portion of the probe body 204*b* may be arranged between the inlets 210*a-b* and help convey formation fluid 122 therebetween.

The fluid sampling tool 114 may additionally include one or more offset arms 212 (two shown) coupled thereto. Similar to the probe extension arms 202, the offset arms 212 are depicted in a recessed state for transportation of the fluid sampling tool 114. However, the offset arms 212 may be extended during operation to contact the borehole wall 103. Advantageously, the offset arms 212 may be used to center the fluid sampling tool 114 and/or the tool string 112 (FIG. 1). Moreover, the offset arms 212 may be operated in cooperation with the probe extension arms 202 to press the pad 206 of the probe 200 against the borehole wall 103 and form a seal therewith.

Figure 3A:
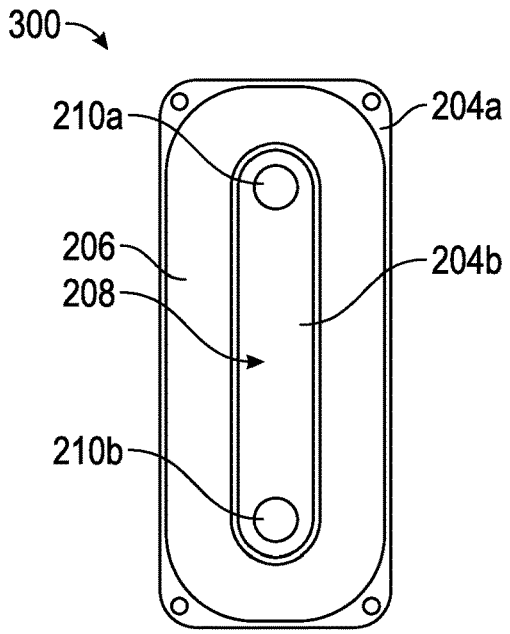
FIGS. 3A and 3B show front and cross-sectional views of an illustrative fluid-sampling probe configuration that may be susceptible to clogging.
Figure 3B:
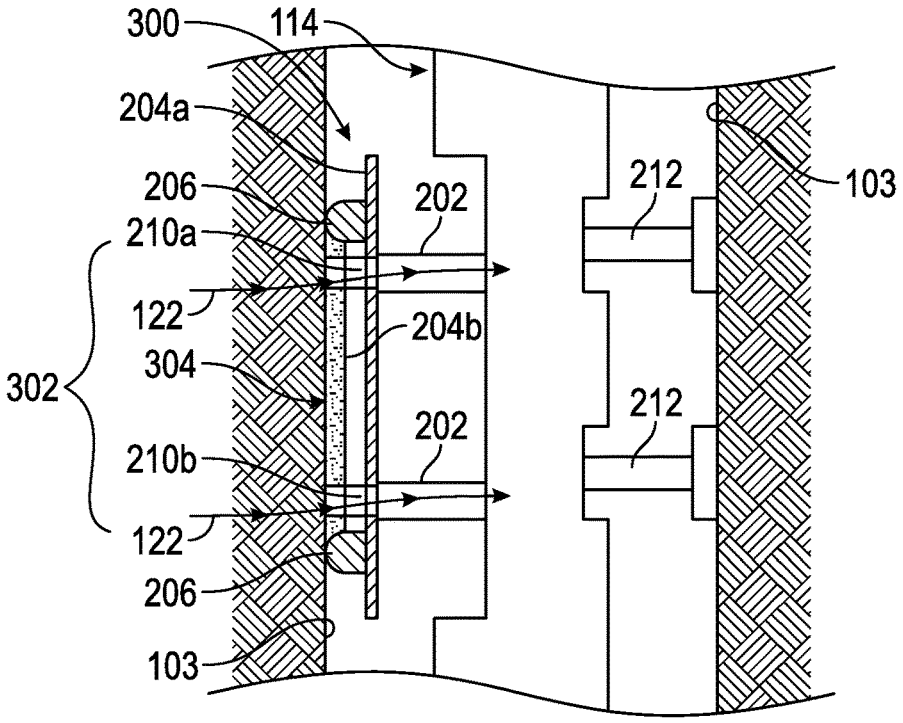

Referring now to FIGS. 3A and 3B, illustrated are front and cross-sectional views of an illustrative fluid-sampling probe 300 (hereinafter "probe 300") not having screens covering the inlets 210*a-b*. The probe 300 may be substantially similar to the probe 200 and therefore may be best understood with reference thereto, where like numerals represent like elements that will not be described again in detail. As depicted in FIG. 3A, the probe 300 includes the probe body base 204*a*, oval shaped pad 206 with a recessed area 208, and two inlets 210*a-b*.

FIG. 3B illustrates a cross-sectional view of the probe 300 coupled to a fluid sampling tool 114. As illustrated, the probe extension arms 202 are extended from the fluid-sampling tool 114, thus the pad 206 of the probe 300 is in contact with and compressed against the borehole wall 103 forming a sealed formation fluid sample area 302. The offset arms 212 are also extended and in contact with the borehole wall 103.

Figure 4A:
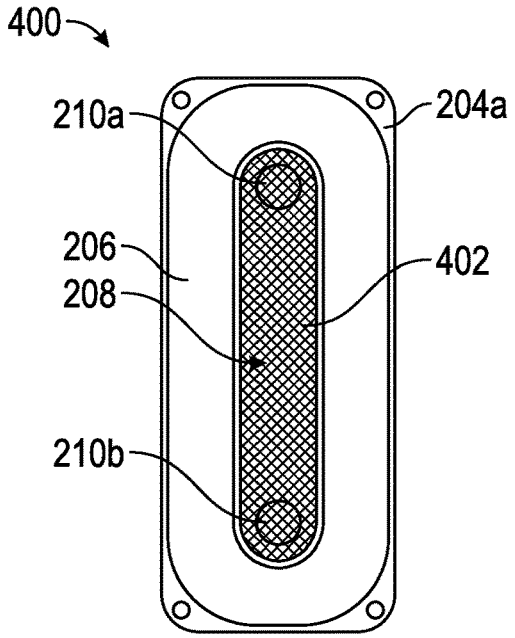
FIGS. 4A-4C show front and cross-sectional views of an illustrative fluid-sampling probe including a plurality of screens.
Figure 4B:
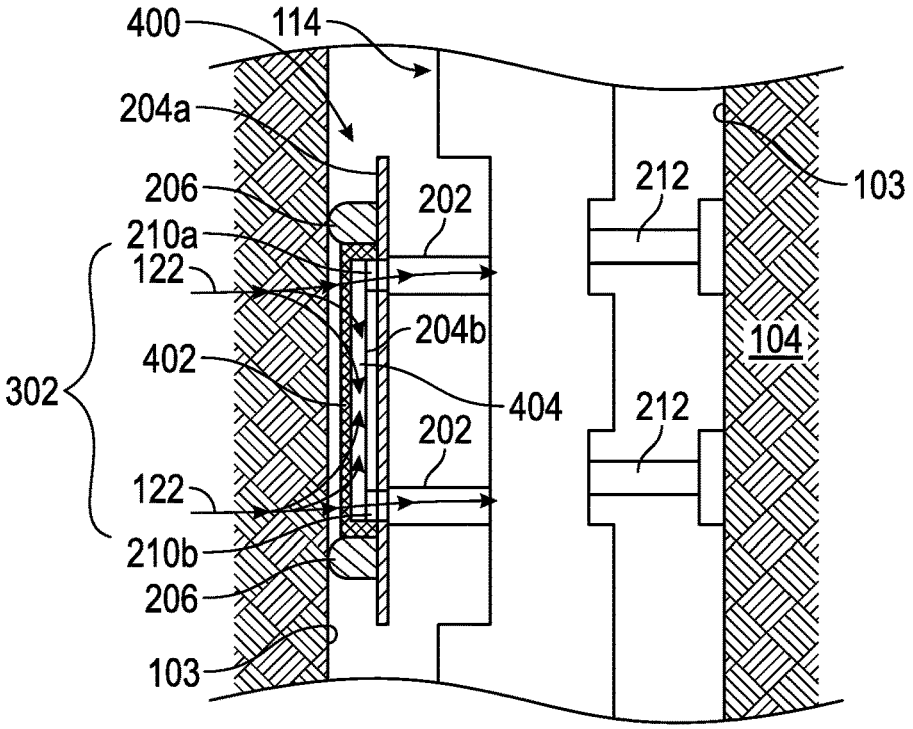

Referring now to FIGS. 4A and 4B, illustrated are front and cross-sectional views of another illustrative fluid-sampling probe 400 (hereinafter "probe 400") including a plurality of screens. The probe 400 may be substantially similar to probes 200 and 300 and therefore may be best understood with reference thereto, where like numerals represent like elements that will not be described again in detail. As depicted in FIG. 4A, the probe 400 includes the probe body base 204*a*, oval shaped pad 206 with a recessed area 208, and two inlets 210*a-b*. The probe 400 further includes a plurality of screens 402 generally covering both of the inlets 210*a-b*.

FIG. 4B illustrates a cross-sectional view of the probe 400 coupled to a fluid sampling tool 114. As illustrated, the probe extension arms 202 are extended from the fluid-sampling tool 114, thus the pad 206 of the probe 400 is in contact with and compressed against the borehole wall 103 forming a sealed formation fluid sample area 302. The offset arms 212 are additionally extended and in contact with the opposing borehole wall 103.

As compared with the probe 300 of FIG. 3, however, the probe 400 includes the plurality of screens 402 arranged between the inlets 210*a-b* and the formation wall 103. The probe 400 further includes a cavity 404 defined between the screens 402 and the probe body exterior 204*b* fluidly connecting the inlets 210*a-b*. As depicted, the screens 402 surround the inlets 210*a-b* and are coupled to the probe body base 204*a*, for example by spot welding. However, it will be appreciated that other coupling methods are contemplated herein and may be implemented, such as friction fitting, or using screws or bolts to secure the screens 402. In the illustrated embodiment, the screens 402 include a major surface portion 402*m* configured to align with the borehole wall 103, as well as an angled standoff portion 402*s* coupled thereto and extending into the hole or recessed area 208 in the sampling probe 200. In this embodiment, the angled standoff portion 402*s* (e.g., shown in one embodiment having an angle θ of about 90 degrees) creates the cavity 404. Moreover, in some embodiments, the screens 402 may be supported by one or more support beams (not shown) within the cavity 404 radially extending from the exterior body 204*b* to the screens. The screens 402 are arranged such that they do not interfere with the pad 206 compressing against and forming a seal with the borehole wall 103.

The screens 402 can function to prevent particulates from reaching the inlets 210*a-b*. In some embodiments, the screens 402 may be of various predetermined sizes to filter certain size particulates corresponding to the sands in the formation 104. Moreover, the screens 402 may arranged in order of decreasing particulate size, wherein the largest screen size (filtering larger particulates) is arranged closest to the borehole wall and the smallest screen size (filtering smaller particulates) is arranged furthest from the borehole wall (closest to the inlets 210*a-b*). For example, a first (most exterior) screen may be capable of filtering particulates of 1400 microns and greater, while a second screen may filter a smaller particulate of 1300 microns and greater, and a third screen (furthest from the borehole wall 103 and closest to the inlets 210*a-b*) may filter an even smaller particulate of 1200 microns and greater. It should be appreciated that screen sizes of more than 1400 microns or less than 1200 microns may be implemented without departed from the scope of the disclosure.

As the formation fluid 122 and particulates are received, they are filtered by the screens 402 prior to entering the cavity 404. Advantageously, this assists preventing the inlets 210*a-b* and internal flow lines (not shown) from becoming clogged. Moreover, the flow of fluid is widened to the entire surface of the screens 402. Additionally, the screen 402 filtering creates a cross flow effect between both inlets 210*a-b*, increasing the ability for the formation fluid 122 to reach either inlet 210*a*—from the middle.

Figure 4C:
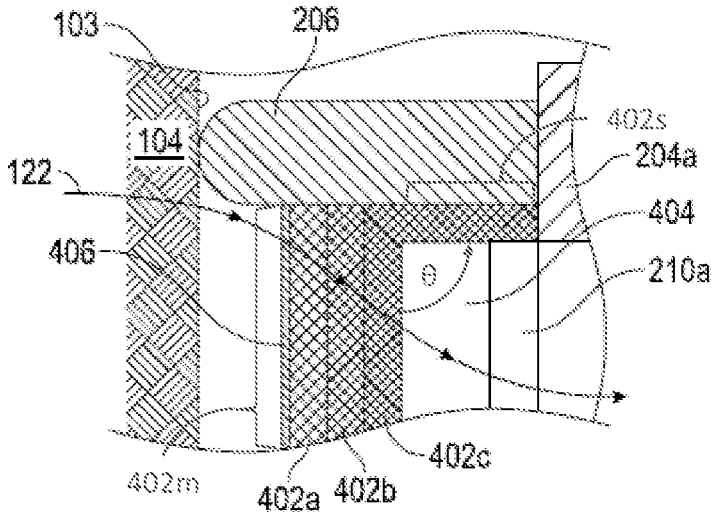

FIG. 4C is an enlarged cross-sectional view of the screens 402. More particularly, FIG. 4C depicts a plurality of screens 402*a-c* (shown as a first screen 402*a*, second screen 402*b*, and third screen 402*c*). As previously described, the screens 402*a-c* may be of various sizes and accordingly only allow certain size particulates to pass through. In some embodiments, as an additional filter measure, the screens 402 may be coated with a chemical treatment comprising one or more chemicals 406. As depicted, the chemicals 406 coat the exterior of the screens 402*a-c* (i.e., the chemicals 406 are closest to the borehole wall 103, layering or coating the first screen 402*a*). Alternatively, or in addition thereto, the chemicals 406 may coat multiple screens or be embedded between the screens 402*a-c*, for example, being embedded between the first screen 402*a* and the second screen 402*b*.

The chemicals 406 may assist to prevent the screens 406*a-c* from plugging due to mud cake buildup as the formation fluid 122 is being received by the inlets 210. Example chemicals 406 that may be used include, for example and without limitation, polylactic acids, glycolic acids, or the like which may generate organic acids through hydrolysis to remove acid-soluble components in the filter cake. Thus, in some embodiments, upon setting of the pad 206, the chemicals 406 on the screen 402*a-c* react with the mud cake to produce an acid that both reduces and disperses the mud cake over the entire interval of the oval pad screen. In other embodiments, the chemicals may react with the mud cake to clump or gel the particulates together, thus forming generally large particulates now filterable by the screens 402*a-c*. As a result, the plugging effects from the mud cake are reduced, permitting increased communication between the formation sand face and the inlets 210*a-b*.

Figure 5:
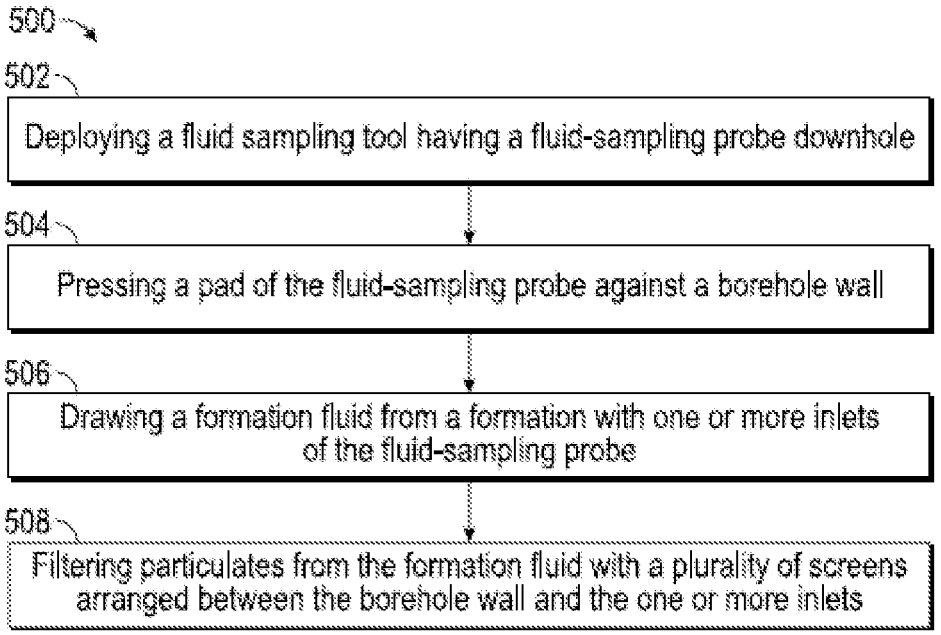
FIG. 5 shows a flowchart of an illustrative formation fluid sampling method.

FIG. 5 shows a flowchart of an illustrative formation fluid sampling method 500. It should be understood that the method 500 may vary and may, for example, include more or less steps. As shown, the method 500 comprises deploying a fluid-sampling tool having a fluid-sampling probe (hereinafter "the probe") downhole, as at block 502. In at least some embodiments, the probe may be coupled to the fluid-sampling tool via a probe extension arm and capable of drawing a formation fluid from a formation.

During operation, the probe extension arm may extend the probe radially outward from the fluid-sampling tool, thereby pressing a pad of the probe against a borehole wall, as at block 504. In some embodiments, the pad may form a seal with the borehole wall, thus preventing borehole fluid from interfering with the sampling operation. Moreover, one or more tool extension arms coupled to the fluid-sampling tool may additionally extend radially outwards to contact the borehole wall and assist forming the seal.

At block 506, a formation fluid may be drawn from a formation with one or more inlets of the probe. At block 508, the probe may perform filtering of particulates from the formation fluid with a plurality of screens arranged between the borehole wall and the inlets. Moreover, in some embodiments, the screens may filter a first size particulate prior to filtering a second size particulate, where the first size is larger than the second size. In further embodiments, the fluid may be dispersed within a fluid cavity with the plurality of screens, the fluid cavity being formed between the plurality of screens and a body of the probe, and fluidly coupling the inlets. Other steps may be included and/or steps may be omitted in different embodiments. Further, the ordering steps may vary in different embodiments.

Numerous variations and modifications will become apparent to those skilled in the art once the above disclosure is fully appreciated. It is intended that the following claims be interpreted to embrace all such variations and modifications.

Embodiments disclosed herein include:

A: A fluid-sampling system, comprising a downhole tool string with a fluid-sampling tool coupled thereto, a fluid sampling probe coupled to the tool via a probe extension arm, the fluid sampling probe having an oval pad that contacts a borehole wall, one or more fluid inlets which receive a formation fluid, and a plurality of screens between the borehole wall and the one or more fluid inlets which filter the formation fluid, and one or more offset arms coupled to the tool which contact the borehole wall.

B: A method of sampling a formation fluid, comprising deploying a fluid sampling tool having a fluid-sampling probe downhole, pressing an oval pad of the fluid-sampling probe against a borehole wall, drawing a formation fluid from a formation with one or more inlets of the fluid-sampling probe, and filtering particulates from the formation fluid with a plurality of screens arranged between the borehole wall and the one or more inlets.

C: A fluid-sampling probe, comprising a pad that contacts a borehole wall, the pad having a recessed area, one or more inlets that receive a formation fluid, and a plurality of screens between the borehole wall and the one or more inlets which filter particulates from the formation fluid.

Each of embodiments A, B, and C may have one or more of the following additional elements in any combination: Element 1: wherein the pad is oval shaped. Element 2: wherein the pad is circularly shaped. Element 3: wherein the pad contacting the borehole wall forms a seal. Element 4: wherein multiple of the plurality of screens have different screen sizes. Element 5: wherein the largest screen size is arranged closest to the borehole wall and screen sizes decrease with the smallest screen size being furthest from the borehole wall. Element 6: wherein the plurality of screens are of a size ranging from 1000 microns to 1400 microns. Element 7: wherein the screens are mounted to the probe using one of the group of spot welding or friction fitting or screwing or bolting. Element 8: wherein a cavity which connects the one or more inlets is at least partially defined between the screens and a body of the tool. Element 9: further comprising a chemical coating coupled to the plurality of screens. Element 10: wherein the chemical coating is one of a polylactic acid or glycolic acid. Element 11: wherein the downhole tool string further comprises a downhole pump which draws the formation fluid from the formation via the one or more fluid inlets. Element 12: wherein the downhole tool string further comprises a fluid analyzer which receives and analyzes the formation fluid via the one or more fluid inlets. Element 13: wherein the downhole tool string further comprises a fluid storage chamber which receives and stores the formation fluid via the one or more fluid inlets. Element 14: wherein pressing the pad against the borehole wall further comprises extending a probe extension arm. Element 15: further comprising extending a tool extension arm to assist pressing the pad against the borehole wall, the tool extension arm being coupled to the fluid sampling tool. Element 16: further comprising dispersing the formation fluid within a fluid cavity with the plurality of screens. Element 17: wherein pressing the pad against the borehole wall forms a seal. Element 18: wherein filtering particulates further comprises filtering a first size particulate prior to filtering a second size particulate, wherein the first size is larger than the second size. Element 19: further comprising dissipating the particulates with a chemical coupled to the plurality of screens. Element 20: wherein the dissipating the particulates occurs prior to filtering the particulates.

What is claimed is:

1. A fluid-sampling system, comprising:

a downhole tool string with a fluid-sampling tool coupled thereto;

a fluid sampling probe coupled to the tool via a probe extension arm, the fluid sampling probe having a pad that contacts a borehole wall, one or more fluid inlets which receive a formation fluid, and a plurality of screens between the borehole wall and the one or more fluid inlets which filter the formation fluid, the plurality of screens having a major surface portion configured to align with the borehole wall and an angled standoff portion coupled thereto and extending into a hole in the fluid sampling probe, wherein the standoff portion creates a cavity between the plurality of screens and the one or more fluid inlets, the plurality of screens creating a cross flow effect in the cavity to increase the ability for the formation fluid to reach the one or more fluid inlets; and one or more offset arms coupled to the tool which contact the borehole wall.

2. The fluid-sampling system of claim 1, wherein the downhole tool string further comprises a downhole pump which draws the formation fluid from the formation via the one or more fluid inlets.

3. The fluid-sampling system of claim 1, wherein the downhole tool string further comprises a fluid analyzer which receives and analyzes the formation fluid via the one or more fluid inlets.

4. The fluid-sampling system of claim 1, wherein the downhole tool string further comprises a fluid storage chamber which receives and stores the formation fluid via the one or more fluid inlets.

5. A method of sampling a formation fluid, comprising:

deploying a fluid sampling tool having a fluid-sampling probe downhole;

pressing a pad of the fluid-sampling probe against a borehole wall;

drawing a formation fluid from a formation with one or more inlets of the fluid-sampling probe; and filtering particulates from the formation fluid with a plurality of screens arranged between the borehole wall and the one or more inlets, the plurality of screens having a major surface portion configured to align with the borehole wall and an angled standoff portion coupled thereto and extending into a hole in the fluid sampling probe, wherein the standoff portion creates a cavity between the plurality of screens and the one or more inlets, the plurality of screens creating a cross flow effect in the cavity to increase the ability for the formation fluid to reach the one or more inlets.

6. The method of claim 5, wherein pressing the pad against the borehole wall further comprises extending a probe extension arm.

7. The method of claim 6, further comprising extending a tool extension arm to assist pressing the pad against the borehole wall, the tool extension arm being coupled to the fluid sampling tool.

8. The method of claim 5, further comprising dispersing the formation fluid within a fluid cavity with the plurality of screens.

9. The method of claim 5, wherein pressing the pad against the borehole wall forms a seal.

10. The method of claim 5, wherein filtering particulates further comprises filtering a first size particulate prior to filtering a second size particulate, wherein the first size is larger than the second size.

11. The method of claim 5, further comprising dissipating the particulates with a chemical coupled to the plurality of screens.

12. The method of claim 11, wherein the dissipating the particulates occurs prior to filtering the particulates.

13. A fluid-sampling probe, comprising:

a pad that contacts a borehole wall, the pad having a recessed area;

a body carrying the pad and defining one or more inlets that receive a formation fluid; and a plurality of screens between the borehole wall and the one or more inlets which filter particulates from the formation fluid, the plurality of screens having a major surface portion configured to align with the borehole wall and an angled standoff portion coupled thereto and extending into a hole in the fluid sampling probe, wherein the standoff portion creates a cavity between the plurality of screens and the one or more inlets, the plurality of screens creating a cross flow effect in the cavity to increase the ability for the formation fluid to reach the one or more inlets.

14. The fluid-sampling probe of claim 13, wherein the pad is oval shaped.

15. The fluid-sampling probe of claim 13, wherein the pad is circularly shaped.

16. The fluid-sampling probe of claim 13, wherein the pad contacting the borehole wall forms a seal.

17. The fluid-sampling probe of claim 13, wherein multiple of the plurality of screens have different screen sizes.

18. The fluid-sampling probe of claim 17, wherein the largest screen size is arranged closest to the borehole wall and screen sizes decrease with the smallest screen size being furthest from the borehole wall.

19. The fluid-sampling probe of claim 17, wherein the plurality of screens are of a size ranging from 1000 microns to 1400 microns.

20. The fluid-sampling probe of claim 13, wherein the screens are mounted to the probe using one of the group of spot welding or friction fitting or screwing or bolting.

21. The fluid-sampling tool of claim 13, further comprising a chemical coating coupled to the plurality of screens.

22. The fluid-sampling probe of claim 21, wherein the chemical coating is one of polylactic acid or glycolic acid.

* * * * *